US008164270B2

(12) United States Patent
Suzuki et al.

(10) Patent No.: US 8,164,270 B2
(45) Date of Patent: Apr. 24, 2012

(54) DISCHARGE LAMP LIGHTING CIRCUIT

(75) Inventors: Tomokazu Suzuki, Shizuoka (JP); Tomoyuki Ichikawa, Shizuoka (JP)

(73) Assignee: Koito Manufacturing Co., Ltd., Tokyo (JP)

( * ) Notice: Subject to any disclaimer, the term of this patent is extended or adjusted under 35 U.S.C. 154(b) by 460 days.

(21) Appl. No.: 12/363,853

(22) Filed: Feb. 2, 2009

(65) Prior Publication Data

US 2009/0195176 A1 Aug. 6, 2009

(30) Foreign Application Priority Data

Feb. 4, 2008 (JP) ..... 2008-024112

(51) Int. Cl.
*H05B 41/36* (2006.01)

(52) U.S. Cl. ..... 315/277; 315/224; 353/85

(58) Field of Classification Search ..... 315/277, 315/220, 224, 307, 247, 292, 316; 353/85
See application file for complete search history.

(56) References Cited

U.S. PATENT DOCUMENTS 5,770,924 A 6/1998 Osterried et al.
6,008,594 A * 12/1999 Kita et al. ..... 315/307
6,172,468 B1 1/2001 Hollander
2006/0197470 A1 9/2006 Ribarich et al.
2009/0315470 A1* 12/2009 Kumagai et al. ..... 315/224

FOREIGN PATENT DOCUMENTS

JP 2002-216982 8/2002

OTHER PUBLICATIONS

Extended European Search Report for Application No. EP 09001543.9, dated Jun. 20, 2011, 6 pages.

* cited by examiner

*Primary Examiner* — Daniel D Chang
(74) *Attorney, Agent, or Firm* — Fish & Richardson P.C.

(57) ABSTRACT

A discharge lamp lighting circuit is capable of preventing the discharge lamp from going out unexpectedly. The discharge lamp lighting circuit includes a DC-AC inverter which receives a power source voltage, boosts and converts the power source voltage into AC and supplies AC electric power to the discharge lamp 21. A control circuit sends a long cycle signal when the discharge lamp 21 is started. The cycle of the long cycle signal is longer than a frequency at the time of steady lighting. The control circuit sends a steady drive signal, which is a frequency at the time of steady lighting, to the DC-AC inverter 25. A cycle of the long cycle signal is set according to at least one of the power source voltage, the temperature of the discharge lamp lighting circuit or the extinguishing time.

5 Claims, 10 Drawing Sheets

| A | B | C | Q2 | Q1 | Q0 | HALF WAVE |
|---|---|---|---|---|---|---|
| 1 | 1 | 1 | 0 | 1 | 0 | 9.6msec |
| 0 | 1 | 1 | 0 | 1 | 1 | 12.8msec |
| 0 | 0 | 1 | 1 | 0 | 0 | 16.0msec |
| 0 | 0 | 0 | 1 | 0 | 1 | 19.2msec |

DISCHARGE LAMP LIGHTING CIRCUIT

CROSS-REFERENCE TO RELATED APPLICATION(S)

This application claims the benefit of priority of Japanese Patent Application No. 2008-024112, filed on Feb. 4, 2008. The contents of that application are incorporated herein by reference.

TECHNICAL FIELD

The present disclosure relates to a discharge lamp lighting circuit for preventing a discharge lamp from going out unexpectedly.

BACKGROUND

Conventionally, when a discharge lamp is lit by AC current, in order to prevent the discharge lamp from going out (i.e., becoming extinguished) unexpectedly, the lighting frequency is decreased in one cycle right after the start of the discharge lamp. This one cycle will be referred to as a DC period. As an electrode temperature of the discharge lamp is low right after the start of the discharge lamp, the electron emitting property for emitting electrons from the electrode is relatively poor right after the polarity is changed. Therefore, the electron emitting property is enhanced by increasing the duration of heating the electrode when the frequency is decreased below the frequency at the time of steady lighting. In this way, the change-over of the polarity at the first time can be accomplished easily. However, if the DC period is too long, the life of the discharge lamp is affected. Therefore, an upper limit of the product of the electric current in the DC period and the time is determined as the rating. This product of the electric current and the time will be referred to as the IT product. Concerning the cycle of the DC period, two systems are provided. In one system, the cycle of the DC period is always set constant regardless of the power source voltage, the state of the discharge lamp and the atmospheric temperature. In the other system, the cycle of the DC period is determined while the electric current and the time are being operated so that the IT product can become constant. For example, Japanese Patent Document JP-A-2002-216982 discloses a discharge lamp lighting circuit by which the DC period is determined when the IT product has reached a predetermined threshold value.

In the former system (the system in which the cycle of the DC period is constant), a scale of the control circuit can be reduced. However, in the case where the cycle of the DC period is short with respect to the electric power supplied to the discharge lamp, there is a possibility that the discharge lamp goes out unexpectedly right after the start of the discharge lamp. Usually, the DC period is determined by the rated electric power supplied to the discharge lamp. Therefore, in the case where the electric power supplied to the discharge lamp is reduced below the rated electric power because the power source voltage of the discharge lamp lighting circuit is decreased or the temperature of the discharge lamp lighting circuit is high, the electrode is not sufficiently heated in the DC period. Accordingly, there is a possibility that the discharge lamp goes out unexpectedly at the time of the first change-over of the polarity.

On the other hand, in the latter system (the system in which the cycle of the DC period is decided by the IT product), it is possible to solve the problems described above. However, it is necessary to execute the operation of the IT product. Therefore, a size of the control circuit for determining the DC period is increased. Accordingly, there is a possibility that the manufacturing cost is raised.

SUMMARY

The present disclosure describes a discharge lamp lighting circuit that can help prevent a discharge lamp from going out unexpectedly. In some cases, a DC period can be generated by a relatively small circuit according to the state of the discharge lamp and also according to a state of the discharge lamp lighting circuit.

According to one aspect of the present invention, a discharge lamp lighting circuit for lighting a discharge lamp comprises: a boosting AC converter which receives a power source voltage, and boosts and converts the power source voltage into AC and supplies AC power to the discharge lamp. A control circuit is arranged to send a long cycle signal, the cycle of which is longer than a frequency at the time of steady lighting, when the discharge lamp is started, and to send a steady drive signal, which is a frequency at the time of steady lighting, to the boosting AC converter. The cycle of the long cycle signal is set by at least one of the power source voltage, the temperature of the discharge lamp lighting circuit, or the extinguishing time. Here, the extinguishing time is a time from when the lighting state is finished till when the lighting operation is performed again in the case of restarting a discharge lamp (hot restart) by the discharge lamp lighting circuit.

Accordingly, the cycle of the long cycle signal is set so that the discharge lamp can be prevented from going out unexpectedly.

In some implementations, the control circuit sets the cycle of the long cycle signal to be longer as the power source voltage is decreased. The control circuit sets the cycle of the long cycle signal to be longer as the extinguishing time is increased. The control circuit sets the cycle of the long cycle signal to be longer as the temperature of the discharge lamp lighting circuit is raised. The control circuit sets the cycle of the long cycle signal to be dispersed.

One or more of the following advantages are obtained in some implementations. For example, it is possible to provide a discharge lamp lighting circuit capable of preventing the discharge lamp from going out unexpectedly when the DC period corresponding to a state of the discharge lamp and also corresponding to a state of the discharge lamp lighting circuit is generated by a relatively small circuit of an open loop.

According to another aspect of the invention, by setting the cycle of the long cycle signal to be long as the power source voltage is decreased, it is possible to prevent the discharge lamp from going out unexpectedly.

According to a further aspect, by setting the cycle of the long cycle signal to be long as the extinguishing time is increased, it is possible to prevent the discharge lamp from going out unexpectedly.

Furthermore, by setting the cycle of the long cycle signal to be long as the temperature of the discharge lamp lighting circuit becomes high, it is possible to prevent the discharge lamp from going out unexpectedly.

Additionally, by setting the cycle of the long cycle signal to be dispersed so as to reduce the circuit scale to be relatively small, it is possible to prevent the discharge lamp from going out unexpectedly.

DETAILED DESCRIPTION OF BEST MODE FOR CARRYING OUT THE INVENTION

The electric discharge lamp lighting circuit described below can be used, for example, for a headlight of a lighting device of an automobile.

According to an implementation of the discharge lamp lighting circuit, the cycle of the DC period, in which a lighting frequency of only one cycle right after the start of the discharge lamp is decreased, is changed according to at least one of the electric power supplied to the discharge lamp, the power source voltage, the temperature of the discharge lamp lighting circuit or the extinguishing time of the discharge lamp. Thus, the cycle of the DC period is determined.

Figure 1:
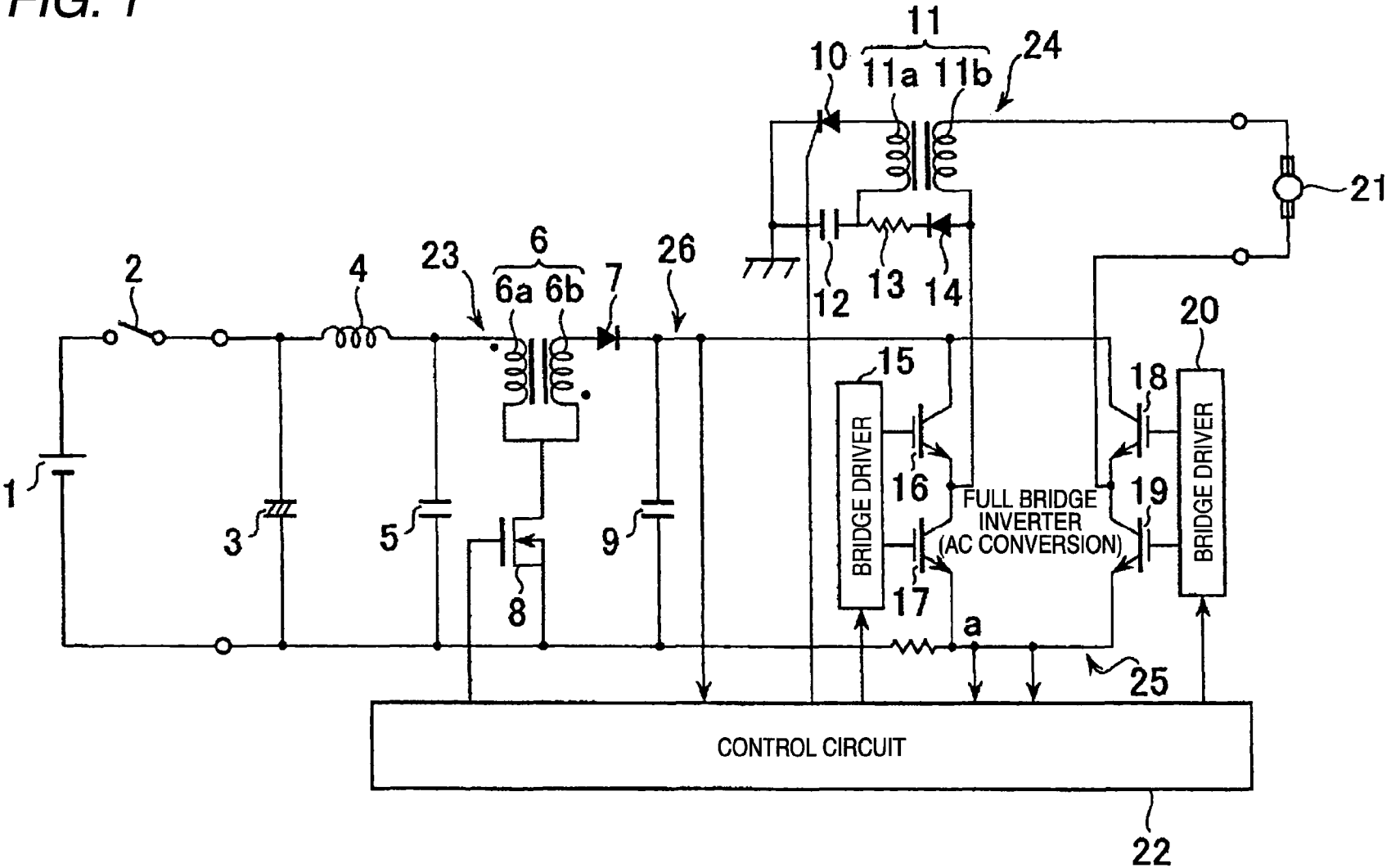
FIG. 1 illustrates an arrangement of the discharge lamp lighting circuit according to an embodiment of the present invention.

As shown in the example of FIG. 1, the discharge lamp lighting circuit includes: a DC power source 1 such as a battery; a DC-DC converter 23; a DC-AC inverter 25; a starting circuit 24; and a control portion 22 for controlling the discharge lamp 21 so that it can be turned on and off. The DC-DC converter 23 receives an input voltage from the DC power source 1 and converts it to a predetermined DC voltage. In this embodiment, a fly-back type DC-DC converter is employed. That is, the DC input voltage, which is supplied through the lighting switch 2 connected to the positive electrode side of the DC power source 1, is supplied to the primary side of the transformer 6 through the inductor 4. The switching element 8 connected to the primary side winding 6*a* of the transformer 6 and the rectifying and smoothing circuit 26 provided on the secondary side winding 6*b* of the transformer 6 can be used for the DC-DC converter 23. In this connection, in FIG. 1, when the windings 6*a*, 6*b* of the transformer 6 are attached with black circles, the starting points of the windings 6*a*, 6*b* are clearly indicated. That is, the polarity of each winding is shown.

The inductor 4 and the condenser 5 are connected to the winding start end side terminal of the primary side winding 6*a* of the transformer 6. One end of the secondary side winding 6*b* (the winding start end side terminal) is connected to the winding end side terminal of the primary side winding 6*a*. Further, the switching element 8 is connected to the winding end side terminal of the primary side winding 6*a*. A signal is sent from the control circuit 22 to the switching element 8. In the present embodiment, an N-channel MOS type FET (the field effect transistor) is used. A drain of the FET is connected to one end of the winding 6*a*, 6*b*, and the source is grounded. When a control signal is supplied to the gate, the switching element is turned on and off. One end of the condenser 3 is connected to a terminal on the lighting switch 2 side of the inductor 4. The other end is connected to the negative electrode side of the DC power source 1.

The rectifying diode 7 and the smoothing condenser 9, which form the rectifying and smoothing circuit 26, are provided on the secondary side of the transformer 6. That is, the winding end side terminal of the secondary side winding 6*b* of the transformer 6 is connected to the anode of the rectifying diode 7. The cathode of the diode 7 concerned is connected to one end of the condenser 9. The other end of the condenser 9 is grounded.

The DC-AC inverter 25 includes: bridge drivers 15, 20, and switching elements 16 to 19. The DC-AC inverter 25 is provided for supplying electric power to the discharge lamp 21 through the starting circuit 24 after an output voltage of the DC-DC converted 23 has been converted into an AC voltage.

The starting circuit 24 includes: a thyrister 10, a diode 14, a transformer 11, a condenser 12 and a resistor 13. The starting circuit 24 generates a high voltage pulse signal (a starting pulse) for starting the discharge lamp 21. The signal concerned is superimposed on the AC voltage from the DC-AC inverter 25 and applied to the discharge lamp 21.

The control circuit 22 controls electric power provided to the discharge lamp 21 when the control circuit 22 receives the voltage given to the discharge lamp 21 and also receives the electric current flowing in the discharge lamp 21, or alternatively when the control circuit 22 receives detection signals corresponding to the voltage and the electric current. At the same time, the control circuit 22 controls an output of the DC-DC converter 23.

For example, the control circuit 22 operates as follows. The control circuit 22 receives detection signals related to the output voltage and the electric current of the DC-DC converter 23. In order for the control circuit 22 to control the supplied electric power corresponding to a state of the discharge lamp 21, the control circuit 22 sends a control signal to the switching element 8 of the DC-DC converter 23 so as to control the output voltage. Concerning the switching control system, PWM system and PFM system are well known. The control circuit 22 sends a signal to the drive circuit 15, 20 of the DC-AC inverter 25 and controls operation of the bridge (e.g., a full bridge). A voltage supplied to the discharge lamp is raised to a predetermined level before the discharge lamp is turned on so that the discharge lamp can be positively turned on. In this connection, the boosting AC converter is a combination of DC-DC converter 23 with the DC-AC inverter 25. However, the present invention is not limited to the above specific embodiment.

In the discharge lamp lighting circuit of this embodiment, in the arrangement described above, while the cycle of the DC period is being established, the DC period is extended according to a reduction of the electric power provided to the discharge lamp. That is, in this discharge lamp lighting circuit, according to a decrease in the power source voltage and a rise of the temperature of the discharge lamp lighting circuit (overheat), electric power inputted into the discharge lamp is reduced so as to protect the discharge lamp lighting circuit. In the case where the discharge lamp is immediately started right after it has been turned off (in the case of restart), in order to suppress an optical output overshoot caused right after the discharge lamp is started, electric power provided to the discharge lamp is decreased corresponding to the extinguishing time of the discharge lamp. In this case, as described above, there is a possibility that the discharge lamp goes out unexpectedly due to the lack of heating the electrode of the discharge lamp.

Figure 2:
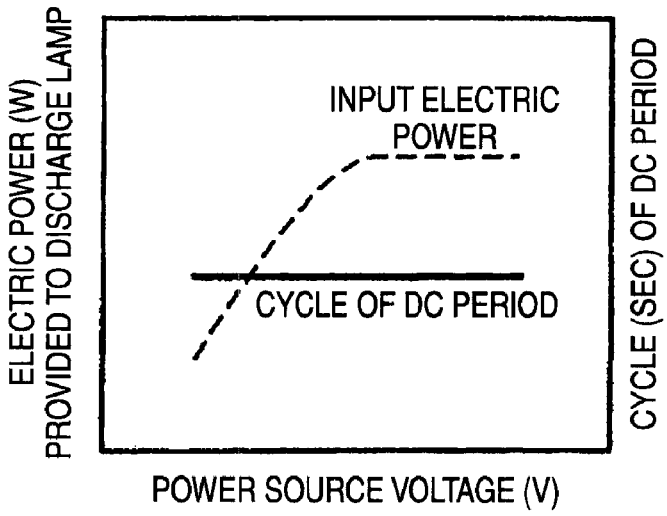
FIG. 2 is a characteristic diagram in the case where a cycle of the DC period is fixed.

Therefore, under the condition that the electric power provided to the discharge lamp is reduced to less than the rated electric power, when the cycle of the DC period is extended, the discharge lamp is prevented from going out unexpectedly. In this case, the cycle of the DC period is extended by reducing the power source voltage, as shown in FIGS. 2 to 5. That is, in the case where the cycle of the DC period is fixed, as shown in FIG. 2, the cycle of the DC period becomes constant regardless of a change in the input voltage. In this connection, in FIG. 2, the broken line shows the characteristic of the input electric power. The abscissa (horizontal axis) shows the power source voltage (V). The ordinate (vertical axis) shows the electric power (W) provided to the discharge lamp. On the other hand, the solid line shows the characteristic of the cycle of the DC period. In the same manner, the horizontal axis shows the power source voltage (V) and the vertical axis shows the cycle (second) of the DC period.

Figure 3:
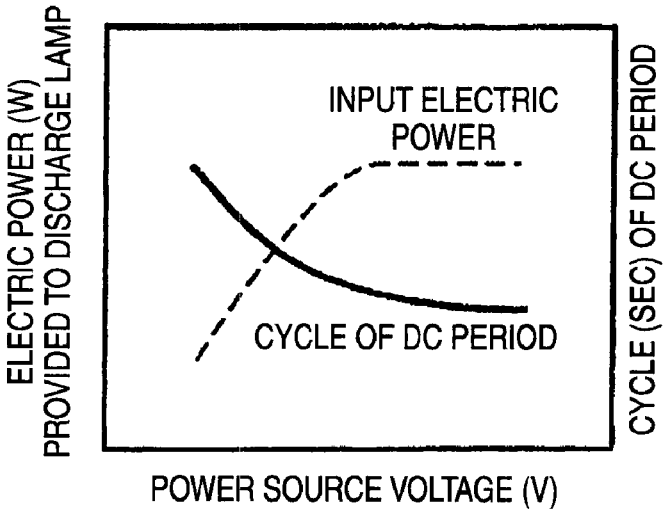
FIG. 3 is a characteristic diagram in the case where a cycle of the DC period varies according to a decrease in power source voltage.
Figure 4:
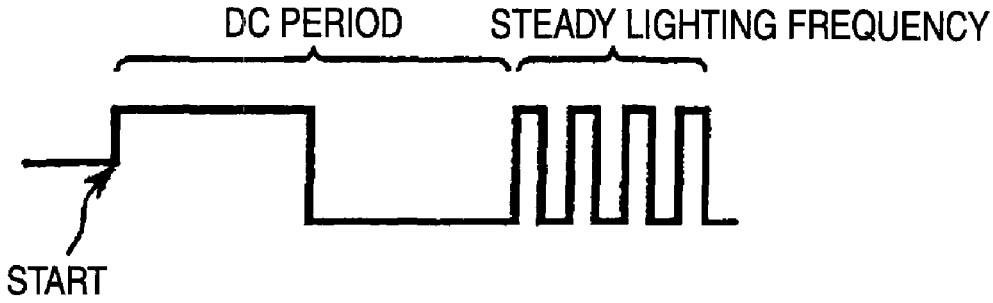
FIG. 4 illustrates a wave-form of a lamp electric current in the case where input electric power is low.
Figure 5:
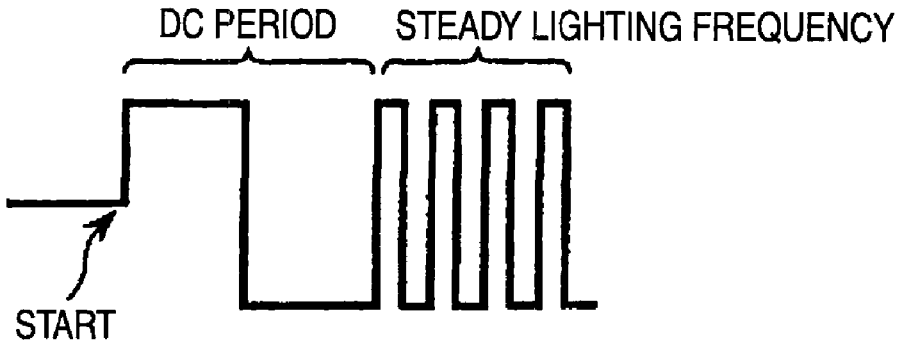
FIG. 5 illustrates a wave-form of a lamp electric current in the case where input electric power is high.

On the other hand, when the cycle of the DC period is extended corresponding to a decrease in the power source voltage, as shown in FIG. 3, the cycle of the DC period is extended as the input electric power is low, and the cycle of the DC period is shortened as the input electric power is high. In this connection, in FIG. 3, the broken line shows the characteristic of the input electric power. The horizontal axis shows the power source voltage (V). The vertical axis shows the electric power (W) provided to the discharge lamp. On the other hand, the solid line shows the characteristic of the cycle of the DC period. In the same manner, the horizontal axis shows the power source voltage (V) and the vertical axis shows the cycle (second) of the DC period. A wave-form of the lamp current is shown in FIGS. 4 and 5. When the input electric power is low, as shown in FIG. 4, the cycle of the DC period is set long. When the input electric power is high, as shown in FIG. 5, the cycle of the DC period is set short.

In this case, the electric power provided to the discharge lamp is determined when states of the discharge lamp lighting circuit and the power source voltage are monitored. As the control portion circuit 22 of the discharge lamp lighting circuit judges a condition of reducing the electric power and operates an amount of the reduction of the electric power, an amount of the reduction of the electric power is already known.

As described before, the DC period is prescribed by the IT product. Therefore, it is possible to determine the DC period from an amount of reduction of electric power. That is, even when the cycle of the DC period is not controlled while the IT product is being operated, it is possible to set an appropriate DC period. According to this method, the cycle of the DC period can be determined by open loop control. Therefore, it is possible to provide a discharge lamp lighting circuit, the starting property of which is excellent, using a relatively small circuit. Further, in the case of restarting a discharge lamp (hot restart), an amount of electric power is provided right after the start of the discharge lamp is reduced when the extinguishing time is short. Therefore, an appropriate cycle of the DC period, in which the life and the starting property are compatible with each other, is different from that in the case of a cold start. When the cycle of the DC period is determined by the extinguishing time, it is possible to set an appropriate DC period in a hot restart. The power source voltage, the temperature of the discharge lamp lighting circuit and the extinguishing time are independent from each other. Therefore, when two or more parameters are combined with each other, an appropriate cycle of the DC period can be set. Here, the extinguishing time is a time from when the lighting state is finished till when the lighting operation is performed again in the case of restarting a discharge lamp (hot restart) by the discharge lamp lighting circuit.

Figure 6:
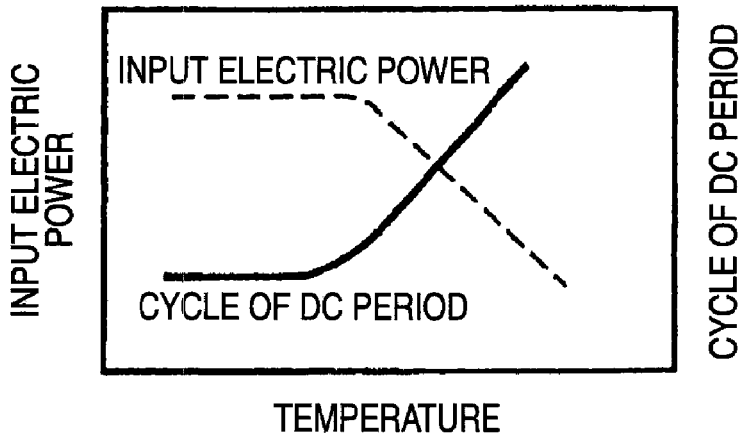
FIG. 6 is a graph showing a relationship between the temperature of the discharge lamp lighting circuit and the input electric power and also showing a relationship between the temperature of the discharge lamp lighting circuit and the cycle of the DC period.
Figure 7:
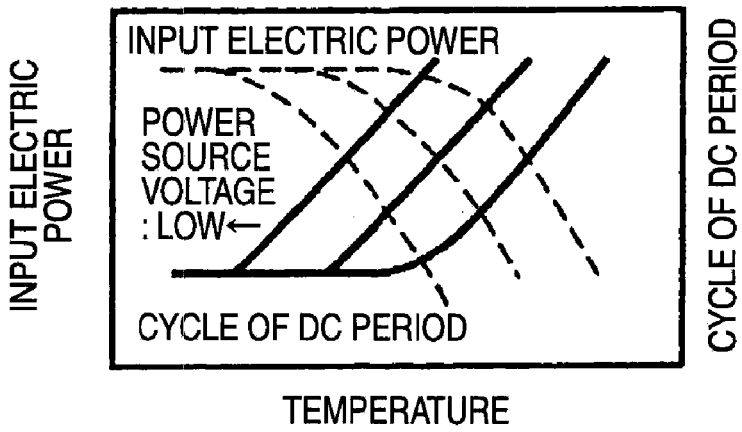
FIG. 7 is a graph showing a relationship between the temperature of the discharge lamp lighting circuit and the input electric power, and also showing a relationship between the temperature of the discharge lamp lighting circuit and the cycle of the DC period, and further showing a relationship between the temperature of the discharge lamp lighting circuit and the power source voltage.
Figure 8:
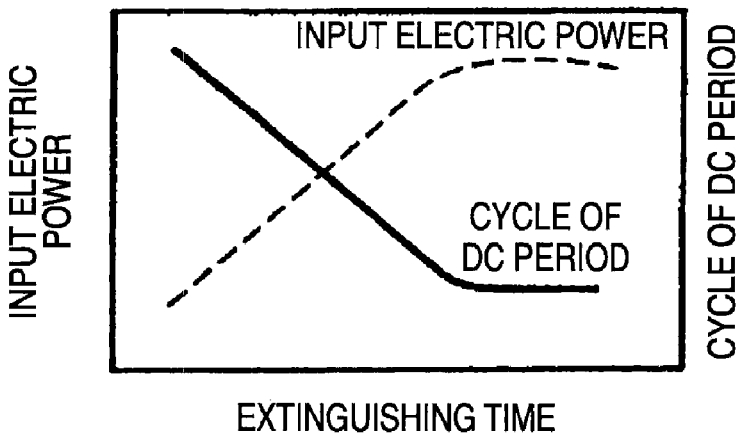
FIG. 8 is a graph showing a relationship between the extinguishing time and the input electric power and also showing a relationship between the extinguishing time and the cycle of the DC period.

FIG. 6 is a graph showing a relationship between the temperature of the discharge lamp lighting circuit and the input electric power and also showing a relationship between the temperature of the discharge lamp lighting circuit and the cycle of the DC period. As shown in FIG. 6, as a temperature of the discharge lamp lighting circuit is raised, the cycle of the DC period is set longer. FIG. 7 is a graph showing a relationship between the temperature of the discharge lamp lighting circuit and the input electric power and also showing a relationship between the temperature of the discharge lamp lighting circuit and the cycle of the DC period and further showing a relationship between the temperature of the discharge lamp lighting circuit and the power source voltage. As shown in FIG. 7, as the power source voltage is decreased, the cycle of the DC period is set to be long. FIG. 8 is a graph showing a relationship between the extinguishing time and the input electric power and also showing a relationship between the extinguishing time and the cycle of the DC period. As shown in FIG. 8, as the extinguishing time of the discharge lamp is long, the cycle of the DC period is set to be long. In this connection, in FIGS. 6-8, the broken line shows the characteristic of the input electric power, and the solid line shows the characteristic of the cycle of the DC period. Further, in FIG. 7, the three broken lines or three solid lines are shown that as the power source voltage is decreased, the lines are shifted to the left.

For the cycle of an appropriate DC period, a resolution, at which the cycle is continuously changed by analogous values, is not required. In many cases, it is sufficient that the cycle is changed by dispersed values. In many cases, the cycle of the DC period is generated by a digital circuit or software. Accordingly, when the cycle of the DC period is such that it can be changed by dispersed values, it is possible to reduce the circuit scale and the manufacturing cost.

Next, an explanation is provided for a circuit arrangement for generating the cycle of the DC period.

Figure 9:
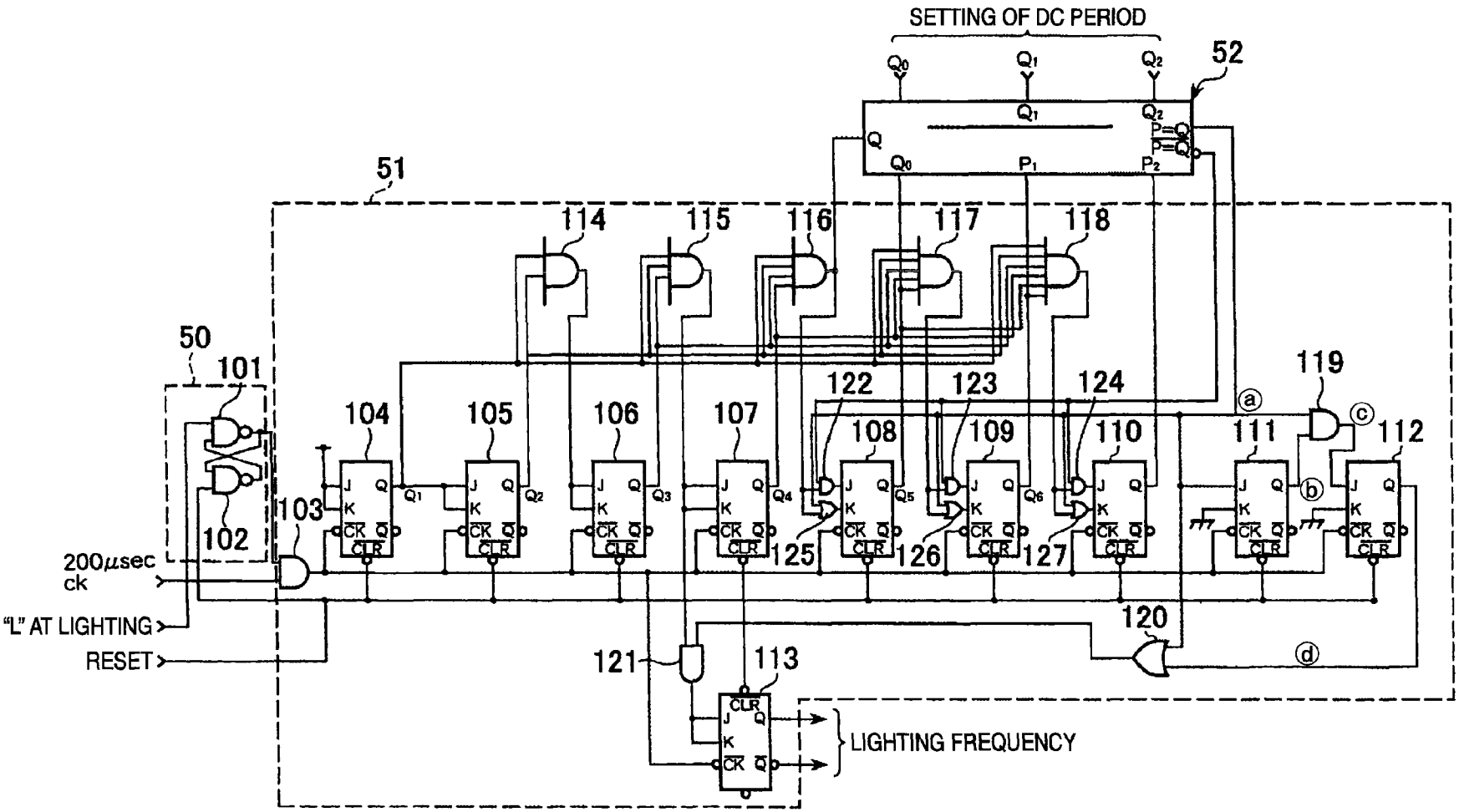
FIG. 9 shows an outline of the arrangement of the generating circuit for generating the cycle of the DC period.

FIG. 9 shows an arrangement of the generating circuit for generating the cycle of the DC period.

As shown in FIG. 9, this generating circuit includes: a latch portion 50; a counter portion 51; and a comparison portion 52. This latch portion 50 has a function of latching (temporarily storing) the lighting information indicating whether or not the discharge lamp is turned on. The latch portion 50 is formed of a RS flip flop having two AND gates 101, 102. In the case where the discharge lamp is turned on, a signal of "L" is provided to the latch portion 50 as the lighting information described and temporarily stored. The counter portion 51 includes a synchronous counter having AND gates 103, 114 to 119, 121 to 124, JK flip flops 104 to 113 and OR gates 120, 125 to 127. Reset signals are provided to the reset terminals of these JK flip flop 104 to 113. One input of AND gate 103 is an output signal of the latch portion 50 and the other input is a clock signal of 5 kHz. The output signal of the AND gate 103 is provided to the clock terminal of the flip flops. In the comparison portion 52, the output signals of JK flip flops 108 to 110 are provided to the terminals P0 to P2, and the output signals related to the set DC period are provided to the terminals Q0 to Q2. Both are compared with each other, and the result of the comparison is provided as an output.

Figure 10:
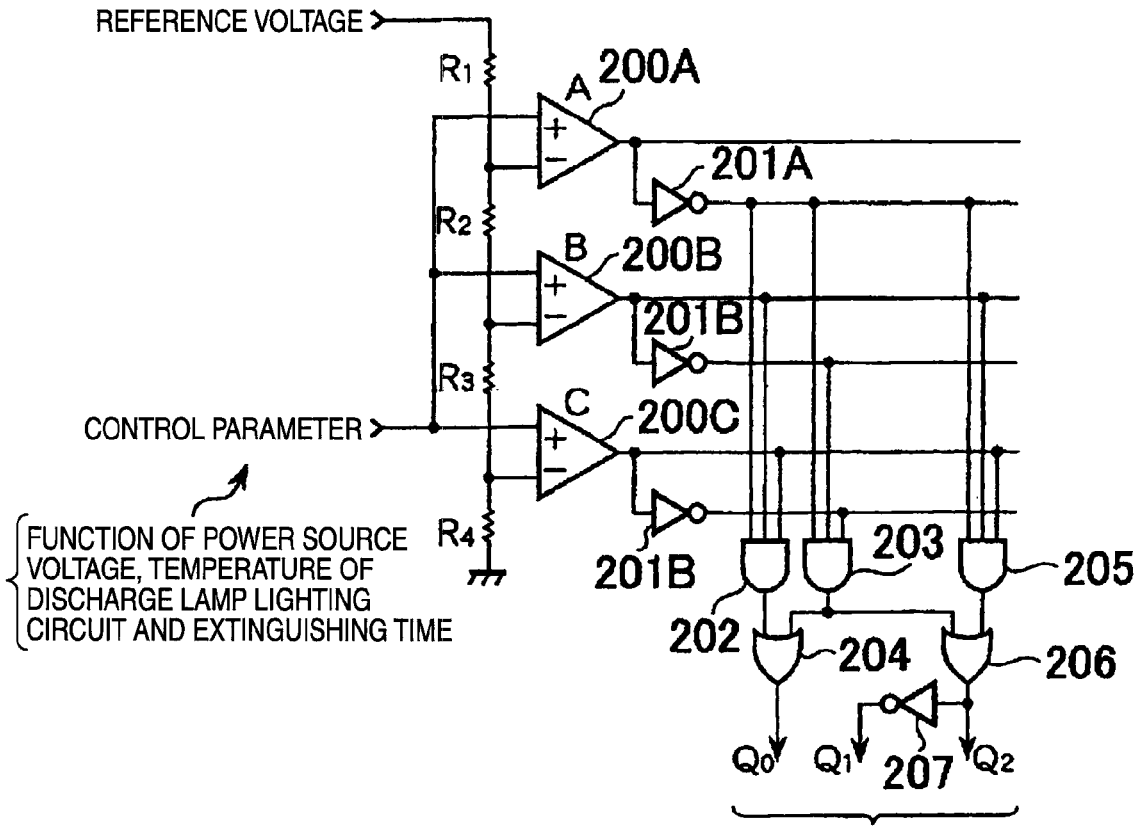
FIG. 10 illustrates an arrangement of a logical circuit in which a cycle of the DC circuit is set.

The cycle of the DC period is set by the circuit shown in FIG. 10.

The circuit shown in FIG. 10 includes: three operation amplifiers 200A to 200C; NOT gates 201A to 201C; AND gates 202, 203, 205; OR gates 204, 206; and NOT gate 207. The control parameter is provided to one input terminal (no inversion input) of each operation amplifier 200A to 200C. A value obtained when the reference voltage is divided by the resistors R1 to R4 is provided to the other input terminal (inversion input). In this case, "the control parameter" is a function of the power source voltage, the temperature of the discharge lamp lighting circuit or the extinguishing time.

Output signals of the operation amplifiers 200A to 200C are supplied to the input terminals of AND gates 202, 203, 205 through NOT gates 201A to 201C. An output signal of AND gate 202 is supplied to one input terminal of OR gate 204. An output signal of AND gate 203 is supplied to the other input terminal of OR gate 204, 206. An output signal of AND gate 205 is supplied to the other input terminal of OR gate 206.

An output signal of OR gate 204 is supplied to the terminal Q0 of the comparison portion 52. An output signal of OR gate 206, which passes through NOT gate 207, is supplied to the terminal Q1 of the comparison portion 52. An output signal of OR gate 206 is supplied to the terminal Q2 of the comparison portion 52. In this connection, the relationships between the signals (Q0 to Q2) supplied to the terminals Q0 to Q2 and the output signals (A to C) of the operation amplifiers 200A to 200C are shown in the logical table of FIG. 12.

Figures 11, 12:
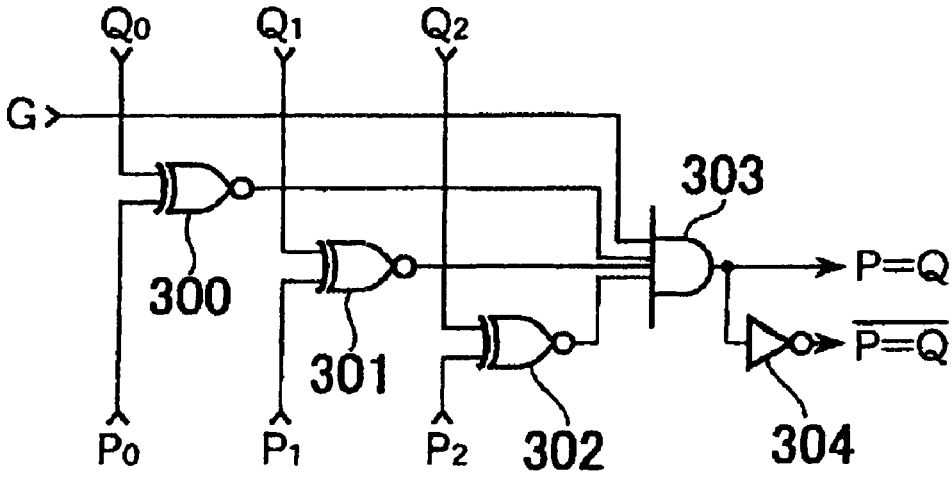
FIG. 11 illustrates a detailed example of a comparison portion.
FIG. 12 is a logical table showing a relationship between states of signals (Q0 to Q2) supplied to terminals Q0 to Q2 shown in FIG. 10 and output signals (A to C) of operation amplifiers 200A to 200C.

The detailed arrangement of the comparison portion 52 is shown in FIG. 11. The illustrated example of this comparison portion 52 includes: three ExNOR gates 300 to 302; AND gate 303; and NOT gate 304. When G input is on level "H" and the signals Q0 to Q2 and the signals P0 to P2 completely agree with each other, the high level "H" signal is provided from the terminal (P=Q).

The control parameter is entered in the circuit shown in FIG. 10, and is set in the control circuit 22. Specifically, each control parameter is set by the circuit shown in FIGS. 13 to 15.

Figure 13:
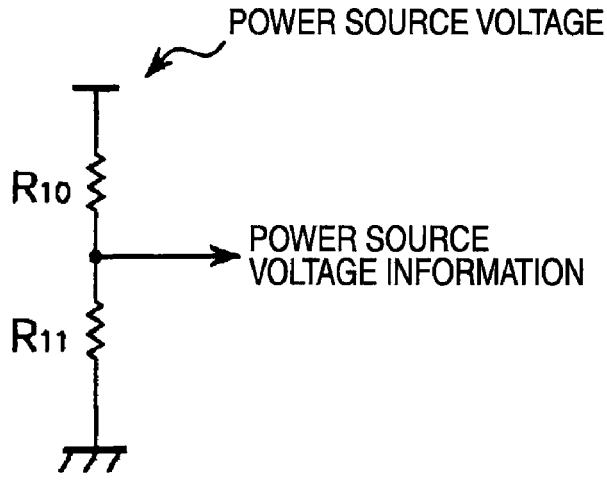
FIG. 13 illustrates an example of a power source voltage detection circuit.
Figure 14:
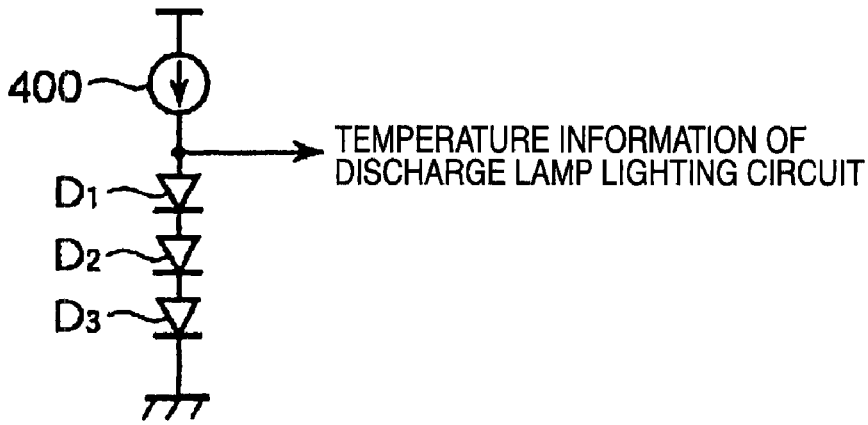
FIG. 14 illustrates an example of a temperature detection circuit.
Figure 15:
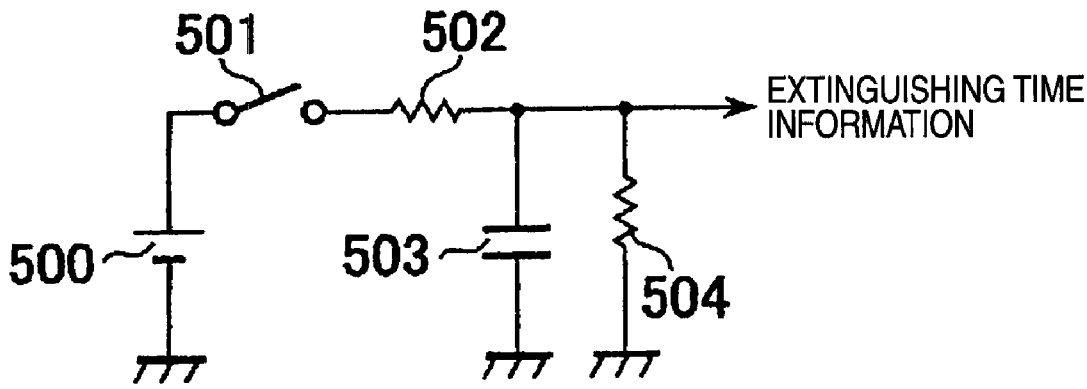
FIG. 15 illustrates an example of an extinguishing time detection circuit.

In the power source voltage detection circuit shown in FIG. 13, the power source voltage is divided by the resistors R10, R11. The divided voltage values are monitored so that a state of the power source voltage can be detected. The power source voltage information value becomes a low value when the power source voltage is low. In the temperature detection circuit shown in FIG. 14, diodes D1, D2, D3 are connected to the stabilized electric current source 400 in series. A voltage drop caused by the temperature characteristic of the diode is monitored, and the temperature information of the discharge lamp lighting circuit is provided as an output. The temperature information value is decreased when a temperature of the discharge lamp lighting circuit is high. An example of the extinguishing time detection circuit is shown in FIG. 15. In the case where the switch 501 is turned on, an electric charge of the power source voltage 500 is accumulated in the condenser 503. In the case where the switch 501 is turned off, an electric charge of the power source voltage 500 is naturally discharged. Therefore, a charged voltage of the condenser 503 is detected, and the extinguishing time information is provided as an output. The extinguishing time information value is low when the extinguishing time is long. However, the present invention is not limited to the foregoing specific embodiment.

Figure 16:
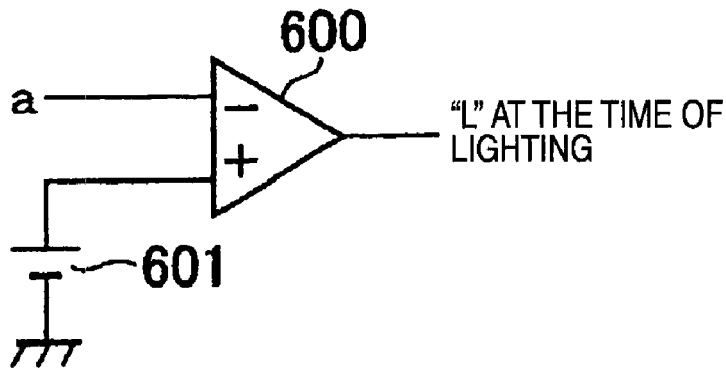
FIG. 16 illustrates an example of a lighting detection circuit.

An arrangement of the circuit, by which a signal of level "L" is provided at the time of lighting the discharge lamp, is shown in FIG. 16. The voltage of node "a" shown in FIG. 1 is provided to the inversion input terminal of the operation amplifier 600. The constant voltage 601, which is a threshold value of turning on and off, is provided to the no inversion input terminal. As a result, when the discharge lamp is turned on, a signal of level "L" is provided as an output.

Figure 17:
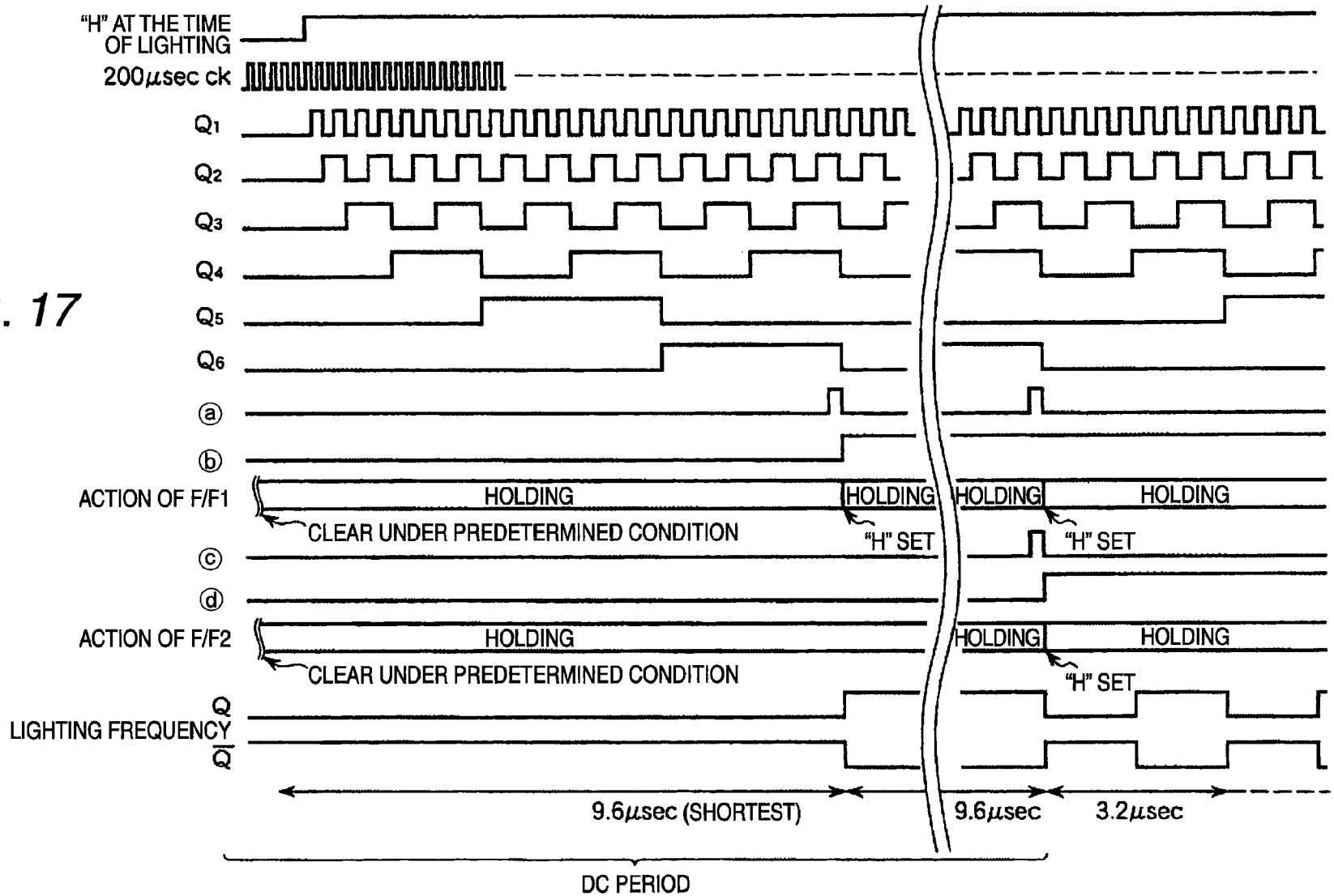
FIG. 17 is a timing chart for explaining setting of a cycle of the DC period.

Referring to the time chart shown in FIG. 17, an action related to the setting of the cycle of the DC period is now explained. In this example, 200 μsec (=5 kHz) is employed for the basic clock, and the setting is made so that the cycle of the DC period can be 9.6 ms at the shortest. When a signal of level L is provided at the time of lighting the discharge lamp, the latch portion 50 is triggered to latch a signal, and JK flip flop 104 to 110 starts counting according to a predetermined manner. In this connection, JK flip flop 112, 113 are cleared by a power only set or by a predetermined condition in which the discharge lamp goes out unexpectedly so that it can be turned on again when a high voltage pulse for starting is generated.

Next, when output signals from Q terminals of JK flip flops 104 to 109 become level "H", the synchronization clear is executed, and the first time polarity changeover is executed.

When a signal of level "H" is provided from the terminal (P=Q) of the comparison portion 52, the following occurs:

(a) a signal of level "H" is provided from the Q terminal of JK flip flop 111 at the timing of the last transition of ck of 200 μsec, and (b) JK flip flop 111 maintains a state of level "H".

Next, when output signals from Q terminals of JK flip flops 104 to 109 become level "H", the second polarity changeover is executed.

At this time, JK flip flop 111 already is maintained in the state of level "H". Therefore, a signal of level "H" is provided from AND gate 119 to J terminal of JK flip flop 112. As a result, from Q terminal of JK flip flop 112 concerned, a signal of level "H" is provided. As a result of the foregoing, JK flip flop 113 maintains a state of level "H". After that, the discharge lamp control is changed over to the lighting control executed by the steady lighting frequency.

According to the values of the power source voltage information, the temperature information and the extinguishing time information, the binary number digital values of Q0 to Q2 are changed and the DC periods are dispersed in a range of 9.6 msec to 19.2 msec (at a half wave) as shown in FIG. 12.

The present invention is not limited to the foregoing specific embodiment. Variations can be made without departing from the scope of claim of the present invention.

For example, in the embodiment described above, explanations are provided about the arrangement in which the power source voltage, the temperature of the discharge lamp lighting circuit and the extinguishing time are used as control parameters for setting the cycle of the DC period. However, other parameters may be used as control parameters.

Accordingly, other implementations are within the scope of the claims.

What is claimed is:

1. A discharge lamp lighting circuit for lighting a discharge lamp comprising:

a boosting AC converter arranged to receive a power source voltage, boost and convert the power source voltage into AC, and supply AC electric power to the discharge lamp; and a control circuit arranged to provide a long cycle signal to the boosting AC circuit converter to set a cycle for a DC period when the discharge lamp is started, the cycle of the long cycle signal being longer than a frequency at a time of steady lighting, the control circuit further being arranged to send a steady drive signal, which is a frequency at the time of steady lighting, to the boosting AC converter, wherein the control circuit is arranged to set the cycle of the long cycle signal according to the power source voltage and an extinguishing time.

2. The discharge lamp lighting circuit according to claim 1, wherein the control circuit is arranged to set the cycle of the long cycle signal to be longer as the power source voltage is decreased.

3. The discharge lamp lighting circuit according to claim 1, wherein the control circuit is arranged to set the cycle of the long cycle signal to be longer as the extinguishing time is increased.

4. The discharge lamp lighting circuit according to claim 1, wherein the control circuit is arranged to set the cycle of the long cycle signal according to a temperature of the discharge lamp lighting circuit, and the control circuit is arranged to set the cycle of the long cycle signal to be longer as the temperature of the discharge lamp lighting circuit is raised.

5. The discharge lamp lighting circuit according to claim 1, wherein the control circuit is arranged to set the cycle of the long cycle signal at dispersed values.

* * * * *